US011708979B2

(12) United States Patent
Kim et al.

(10) Patent No.: US 11,708,979 B2
(45) Date of Patent: Jul. 25, 2023

(54) AIR CONDITIONER

(71) Applicant: SAMSUNG ELECTRONICS CO., LTD., Suwon-si (KR)

(72) Inventors: Byung Ghun Kim, Suwon-si (KR); Do-Hoon Kim, Suwon-si (KR); Woo Seok Song, Yongin-si (KR); Jun Hwang, Suwon-si (KR); Jong Moon Kim, Hwaseong-si (KR); Hyeong Joon Seo, Suwon-si (KR); Jong Moon Lee, Suwon-si (KR); Jun Hwa Lee, Suwon-si (KR); Hyeong Kyu Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 548 days.

(21) Appl. No.: 16/644,729

(22) PCT Filed: Aug. 29, 2018

(86) PCT No.: PCT/KR2018/010010
§ 371 (c)(1),
(2) Date: Mar. 5, 2020

(87) PCT Pub. No.: WO2019/050213
PCT Pub. Date: Mar. 14, 2019

(65) Prior Publication Data

US 2020/0263882 A1 Aug. 20, 2020

(30) Foreign Application Priority Data

Sep. 5, 2017 (KR) ..... 10-2017-0113053

(51) Int. Cl.
*F24F 1/0014* (2019.01)
*F24F 1/0047* (2019.01)

(52) U.S. Cl.
CPC ..... *F24F 1/0014* (2013.01); *F24F 1/0047* (2019.02)

(58) Field of Classification Search
CPC ..... F24F 1/0014; F24F 1/0047; F24F 13/413; F24F 7/10; F24F 13/06; F24F 13/075;
(Continued)

(56) References Cited

U.S. PATENT DOCUMENTS

2015/0007967 A1* 1/2015 Jeong ..... F24F 13/081 454/237
2018/0313552 A1* 11/2018 Lee ..... F24F 1/0047

FOREIGN PATENT DOCUMENTS

CN 1936437 A 3/2007
JP 2002-22256 1/2002
(Continued)

OTHER PUBLICATIONS

Eguchi, Akihiro, JP2002022256 Translation.pdf, "Wind direction control plate of air conditioner", pp. 1-22.*
(Continued)

*Primary Examiner* — Avinash A Savani
*Assistant Examiner* — Ryan L Faulkner
(74) *Attorney, Agent, or Firm* — Staas & Halsey LLP

(57) ABSTRACT

Disclosed herein is an air conditioner. The air conditioner includes a housing having an inlet and an outlet, a blade having a plurality of discharge holes and provided to discharge air through the plurality of discharge holes, a first opening formed between one side of the blade near the inlet and the housing when the blade discharges air through the plurality of discharge holes, and a second opening formed between the housing and the other side opposite to the one side of the blade when the blade discharges air through the plurality of discharge holes.

12 Claims, 8 Drawing Sheets

(58) Field of Classification Search
CPC ..... F24F 13/08; F24F 13/081; F24F 13/10; F24F 13/14; F24F 13/24; F24F 2221/14
USPC ..... 454/233
See application file for complete search history.

(56) References Cited

FOREIGN PATENT DOCUMENTS

| | | | |
|---|---|---|---|
| JP | 2007-163010 | | 6/2007 |
| JP | 5923871 | | 4/2016 |
| KR | 10-2008-0056476 | A | 6/2008 |
| KR | 10-2009-0010451 | A | 1/2009 |
| KR | 10-2012-0041222 | | 4/2012 |
| KR | 10-1362320 | | 2/2014 |
| KR | 10-2016-0006968 | A | 1/2016 |
| KR | 10-1698842 | | 1/2017 |
| KR | 10-2017-0048128 | | 5/2017 |
| WO | WO 2017/134762 | | 8/2017 |

OTHER PUBLICATIONS

Korean Office Action dated Aug. 14, 2020, in corresponding Korean Patent Application No. 10-2017-0113053.
Chinese Office Action dated Apr. 19, 2021, in corresponding Chinese Patent Application No. 201880057338.7.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2018/010010 filed on Aug. 29, 2018, which claims foreign priority benefit under 35 U.S.C. § 119 of Korean Patent Application No. 10-2017-0113053 filed on Sep. 5, 2017 in the Korean Intellectual Property Office, the contents of both of which are incorporated herein by reference.

TECHNICAL FIELD

The present disclosure relates to an air conditioner, and more particularly, to an air conditioner having an improved airflow control structure.

BACKGROUND ART

In general, an air conditioner is an electronic appliance for maintaining indoor air at pleasant temperature using a cooling cycle of refrigerants. The air conditioner includes an indoor unit, an outdoor unit, and a refrigerant pipe, wherein the indoor unit includes a heat exchanger, a blower fan, etc. and is installed indoor, the outdoor unit includes a heat exchanger, a blower fan, a compressor, a condenser, etc. and is installed outdoor, and the refrigerant pipe connects the indoor unit to the outdoor unit and circulates refrigerants.

The air conditioner can be classified into a stand type air conditioner in which an indoor unit is installed on the floor, a wall-mounted air conditioner in which an indoor unit is mounted on a wall, and a ceiling type air conditioner in which an indoor unit is mounted on a ceiling, according to places where the indoor unit is installed. In the ceiling type air conditioner, the indoor unit is embedded into or hung on the ceiling.

Since the indoor unit of the ceiling type air conditioner is mounted on the ceiling, an inlet for inhaling indoor air, and an outlet for discharging air heat-exchanged through the heat exchanger to the indoor space are disposed in the lower part of the main body. The indoor unit of the ceiling type air conditioner can be classified into a 1-way type with a single outlet and a 4-way type with four outlets forming a quadrangle, according to the number of outlets.

Generally, the indoor unit of the air conditioner includes a blade for adjusting a direction in which heat-exchanged air is discharged, in the outlet. The blade is rotatably coupled with one part of the outlet. A motor is installed on at least one side of the blade and the blade can rotate by receiving a rotatory force from the motor.

DISCLOSURE

Technical Problem

Therefore, it is an aspect of the present disclosure to provide an air conditioner capable of preventing air discharged from an outlet from being re-introduced into an inlet.

It is another aspect of the present disclosure to provide an air conditioner having various air discharge methods.

It is still another aspect of the present disclosure to provide an air conditioner capable of cooling and/or heating the room with a minimum wind speed at which a user feels comfortable.

Technical Solution

In accordance with an aspect of the present disclosure, an air conditioner includes a housing having an inlet and an outlet, a blade having a plurality of discharge holes and provided to discharge air through the plurality of discharge holes, a first opening formed between one side of the blade near the inlet and the housing when the blade discharges air through the plurality of discharge holes, and a second opening formed between the housing and the other side opposite to the one side of the blade when the blade discharges air through the plurality of discharge holes.

The housing may include a first guide portion to guide air discharged through the first opening in a direction away from the inlet.

The first guide portion may extend inside the outlet such that at least a portion of the first guide portion is disposed below the blade when the blade discharges air through the plurality of discharge holes.

When the blade discharges air through the plurality of discharge holes, and when a length along the horizontal direction of the blade is L and a length in which the first guide portion and the blade overlap in the horizontal direction is O, the length in which the first guide portion and the blade overlap in the horizontal direction and the length along the horizontal direction of the blade may satisfy the following formula, $$0.001 \leq O/L \leq 0.27$$

The first guide portion may guide the air discharged through the first opening so that air discharged through the first opening pushes air discharged through the plurality of discharge holes in a direction away from the inlet when the blade discharges air through the plurality of discharge holes.

When the blade discharges air through the plurality of discharge holes, and when a height along the direction of gravity of the outlet is H and a height along the direction of gravity of the first opening is G1, the height of the outlet along the direction of gravity and the height along the direction of gravity of the first opening may satisfy the following formula, $$0.01 \leq G1/H \leq 0.35$$

The first opening may be configured to discharge air at a speed faster than a speed of air discharged through the plurality of discharge holes when the blade discharges air through the plurality of discharge holes.

The second opening may be configured to discharge air at a speed faster than a speed of air discharged through the plurality of discharge holes when the blade discharges air through the plurality of discharge holes.

The second opening may be disposed such that air discharged through the second opening pushes downward the air discharged through the plurality of discharge holes when the blade discharges air through the plurality of discharge holes.

The housing may include a second guide portion to guide air discharged through the second opening in the direction of gravity.

The second guide portion may guide the air discharged through the second opening so that the air discharged through the second opening pushes the air discharged through the plurality of discharge holes downward when the blade discharges air through the plurality of discharge holes.

When the blade discharges air through the plurality of discharge holes, and when a height of the outlet along the direction of gravity is H and a height along the direction of gravity of the second opening is G2, the height of the outlet along the direction of gravity and the height of the second opening along the direction of gravity may satisfy the following formula, $$0.01 \leq G2/H \leq 0.022$$

When a length of the blade along the horizontal direction is L and a length from the inner end to the outer end of the outlet is M, the height of the blade along the horizontal direction and the length from the inner end to the outer end of the outlet may satisfy the following formula, $$M < L$$

The housing may be installed on a ceiling.

In accordance with another aspect of the present disclosure, an air conditioner includes a housing having an inlet and an outlet, a blade having a plurality of discharge holes and provided to discharge air through the plurality of discharge holes, a first guide portion provided at the housing and extending inward of the outlet to be spaced apart from a side of the blade near the inlet when the blade discharges air through the plurality of discharge holes, and a second guide portion provided at the housing and spaced apart from a side of the blade far from the inlet when the blade discharges air through the plurality of discharge holes.

At least a portion of the first guide portion may be disposed below one end of the blade near the inlet.

The first guide portion may be disposed such that a distance between the first guide portion and one end near the inlet of the blade is greater than a diameter of the plurality of discharge holes of the blade.

The second guide portion may be disposed such that a distance between the second guide portion and one end far from the inlet of the blade is greater than a diameter of the plurality of discharge holes of the blade.

The second guide portion may include a guide curved portion to guide air discharged along the second guide portion in the direction of gravity.

In accordance with still another aspect of the present disclosure, an air conditioner includes a housing having an inlet and an outlet, and a blade having a plurality of discharge holes and rotatably disposed between a first position to guide air discharged through the outlet and a second position to discharge air through the plurality of discharge holes, wherein when the blade is in the second position, one side of the blade adjacent the inlet is spaced apart from a first inner wall of the housing forming the outlet, the other side opposite to one side of the blade is spaced apart from a second inner wall of the housing forming the outlet, and air discharged through the one side and the other side of the blade is discharged at a higher speed than air discharged through the plurality of discharge holes.

Advantageous Effects

As is apparent from the above description, the air conditioner can prevent the air discharged from the outlet from being reintroduced into the inlet since the first opening is formed by separating one side near the inlet of the blade from the housing.

The air conditioner can discharge air in a variety of ways as the blades are provided with a plurality of discharge holes.

The air conditioner can cool and/or heat the room with the minimum wind speed at which the user feels comfortable as the blade is provided with a plurality of discharge holes.

MODES OF THE INVENTION

Figure 1:
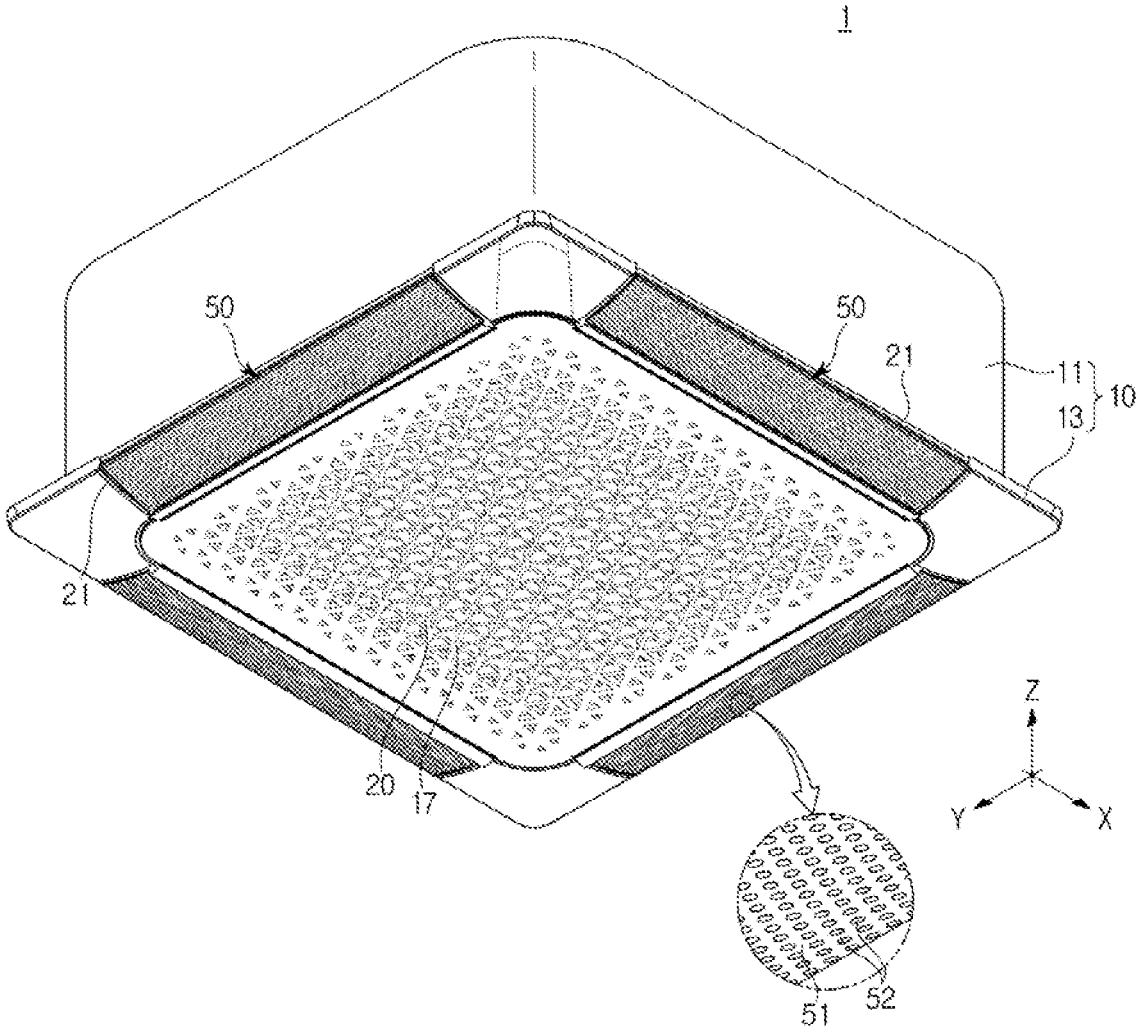
FIG. 1 is a perspective view showing an air conditioner according to an embodiment of the present disclosure.

Configurations illustrated in the embodiments and the drawings described in the present specification are only embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having" are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

As used herein, the term "and/or" includes any and all combinations of one or more of the associated listed items.

Meanwhile, the terms "upper", "lower", "lower side", "front end", and "front, rear, left, right" are defined based on the drawings and the shape and position of each element are not limited by these terms.

A refrigeration cycle of an air conditioner is performed by using a compressor, a condenser, an expansion valve, and an evaporator. The refrigeration cycle includes a series of processes involving compression, condensation, expansion, and evaporation and supplies conditioned air that is heat-exchanged with a refrigerant.

The compressor compresses a refrigerant gas in a high-temperature and high-pressure state and discharges the compressed refrigerant gas. The discharged refrigerant gas flows into the condenser. The condenser condenses the compressed refrigerant into a liquid phase and heat is released to the surroundings via a condensation process.

The expansion valve expands the liquid phase refrigerant in a high-temperature and high-pressure state, which is condensed in the condenser, into a liquid phase refrigerant in a low-pressure. The evaporator evaporates the refrigerant expanded in the expansion valve and returns the refrigerant gas in a low-temperature and low-pressure state to the compressor. The evaporator may achieve refrigeration effects via heat exchange with a material to be cooled using latent heat of evaporation of the refrigerant. The air conditioner may adjust temperature of an indoor space throughout this cycle.

An outdoor unit of the air conditioner refers to a part of the refrigeration cycle including the compressor and an outdoor heat exchanger. An indoor unit of the air conditioner includes an indoor heat exchanger, and the expansion valve may be provided in the indoor unit or the outdoor unit. The indoor heat exchanger and the outdoor heat exchanger serve as a condenser or an evaporator. When the indoor heat exchanger is used as a condenser, the air conditioner serves as a heater, and when the indoor heat exchanger is used as an evaporator, the air conditioner serves as a cooler.

Hereinafter, embodiments of the present disclosure will be described in detail with reference to the accompanying drawings.

Also, although an indoor unit of a ceiling-type air conditioner will be described by way of example for descriptive convenience, a blade according to an embodiment may also be applied to indoor units of any other types of air conditioners such as standing-type air conditioners and wall-mounted air conditioners.

Figure 2:
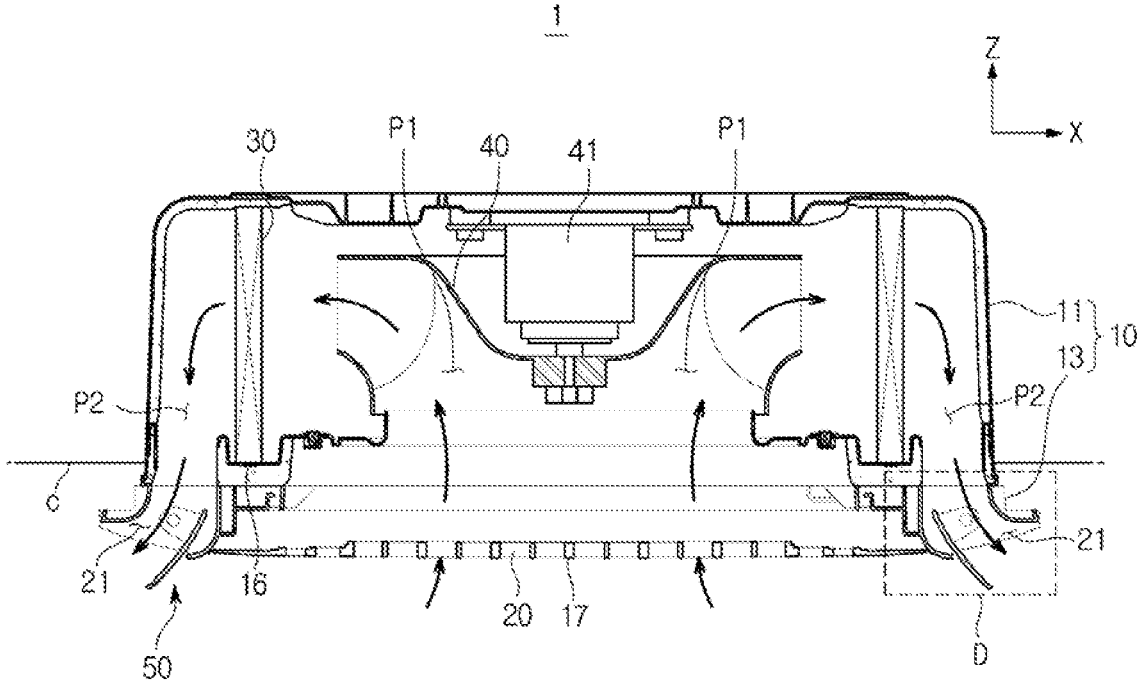
FIG. 2 is a side cross-sectional view of the air conditioner shown in FIG. 1.

FIG. 1 is a perspective view showing an air conditioner according to an embodiment of the present disclosure. FIG. 2 is a side cross-sectional view of the air conditioner shown in FIG. 1.

Referring to FIGS. 1 and 2, an air conditioner 1 according to an embodiment of the present disclosure may be installed in a ceiling C. At least a portion of the air conditioner 1 may be embedded in the ceiling C. The air conditioner 1 according to an embodiment of the present disclosure may be provided in a 4-way type.

The air conditioner 1 may include a housing 10 having an inlet 20 and an outlet 21, a heat exchanger 30 provided inside the housing 10, and a blower fan 40 for flowing air.

The housing 10 may have a rectangular housing shape opening downward to accommodate components of the air conditioner 1 therein. The housing 10 may include an upper housing 11 disposed within the ceiling C, and a lower housing 13 coupled to the upper housing 11. The upper housing 11 may not be disposed inside the ceiling C but may hang on the ceiling C as well.

The inlet 20 through which air is introduced may be formed at a central portion of the lower housing 13, and the outlet 21 through which air is discharged may be formed on the outer side of the inlet 20. An inflow path P1 through which air introduced through the inlet 20 flows may be provided between the inlet 20 and the blower fan 40, and an outflow path P2 through which the air discharged by the blower fan 40 flows may be provided between the blower fan 40 and the outlet 21.

The outlets 21 may be formed adjacent to the respective rims so as to correspond to the outer rims of the lower housing 13. Four outlets 21 may be formed. Two outlets 21 may be formed in the X-axis direction and remaining two outlets 21 may be formed in the Y-axis direction. Four outlets 21 are arranged to discharge air to the four sides of the room, respectively. The air conditioner 1 may cool or heat the inflow air from the lower side and then discharge it back to the lower side.

A grille 17 may be coupled to the bottom surface of the lower housing 13 to filter out dust from the air introduced through the inlet 20.

The heat exchanger 30 may be formed in the shape of a rectangular ring and may be disposed on the outer side of the blower fan 40 inside the housing 10. The heat exchanger 30 is not limited to a rectangular ring, and may be provided in various shapes such as a circular, elliptical or polygonal shape.

The heat exchanger 30 may be placed in a drain tray 16, and condensate generated in the heat exchanger 30 may be collected in the drain tray 16. The drain tray 16 may be formed in a shape corresponding to the shape of the heat exchanger 30. When the heat exchanger 30 is in the form of a rectangular ring, the drain tray 16 may also be in the form of a rectangular ring, and when the heat exchanger 30 is circular, the drain tray 16 may also be circular.

The blower fan 40 may be disposed at the center of the housing 10. The blower fan 40 may be provided inside the heat exchanger 30. The blower fan 40 may be a centrifugal fan in which the air introduced in the axial direction is radially discharged. The air conditioner 1 may be provided with a blowing motor 41 for driving the blower fan 40.

The blade 50 may be provided rotatably on the outlet 21. The blade 50 may be rotatably disposed between a first position for guiding air discharged through the outlet 21 and a second position for discharging air through a plurality of discharge holes 52 formed in a blade 50. The blade 50 may rotate about a rotation axis 53.

Figure 3:
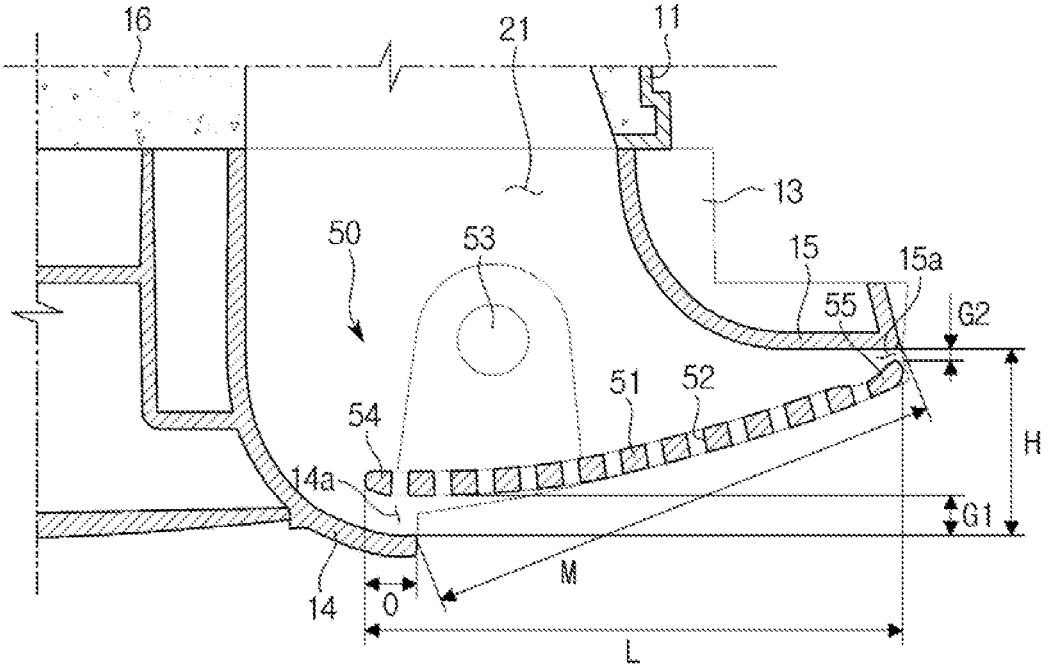
FIG. 3 is an enlarged view of a portion 'D' shown in FIG. 2.

Referring to FIG. 3, the blade 50 may be provided such that the length L along the horizontal direction is larger than the length M from the inner end to the outer end of the outlet 21. The length L along the horizontal direction of the blade 50 may be greater than the length M from the inner end of the outlet 21 in which a first guide portion 14 is formed to the outer end of the outlet 21 in which a second guide portion 15 is formed.

The blade 50 may be configured to be rotatable within a predetermined angle range from the first position so as to control the direction in which the air introduced by the blower fan 40 is discharged from the outlet 21 when the blade 50 is in the first position.

The blade 50 may be provided such that the air introduced by the blower fan 40 passes through the outlet 21 and is discharged to the outside of the housing 10 through the plurality of discharge holes 52 when the blade 50 is in the second position (i.e. when the blade 50 discharges air through the plurality of discharge holes).

The blade 50 may include a blade body 51 and the plurality of discharge holes 52 penetrating the blade body 51. Air that has passed through the outlet 21 through the plurality of discharge holes 52 may be discharged to the outside of the housing 10. The plurality of discharge holes 52 may be distributed so as to be spaced apart at regular intervals, but are not limited thereto and may be distributed intensively in a specific region of the blade body 51.

When the total area of the blade body 51 is A and the total area of a plurality of discharge holes 52 formed in the blade body 51 is B, the total area of the blade body 51 and the total area of the plurality of discharge holes 52 may satisfy the following formula.

$$0.03 \leq B/A \leq 0.48$$

The air conditioner 1 may discharge air to the outside of the housing 10 at a low speed by discharging the air through the plurality of discharge holes 52. The air conditioner 1 may improve the user's satisfaction because the user may achieve the purpose of air conditioning without direct wind.

The air conditioner 1 may cool indoor air introduced into the housing 10 and then discharge it to the room or may heat indoor air introduced into the housing 10 and then discharge it to the room.

Figure 4:
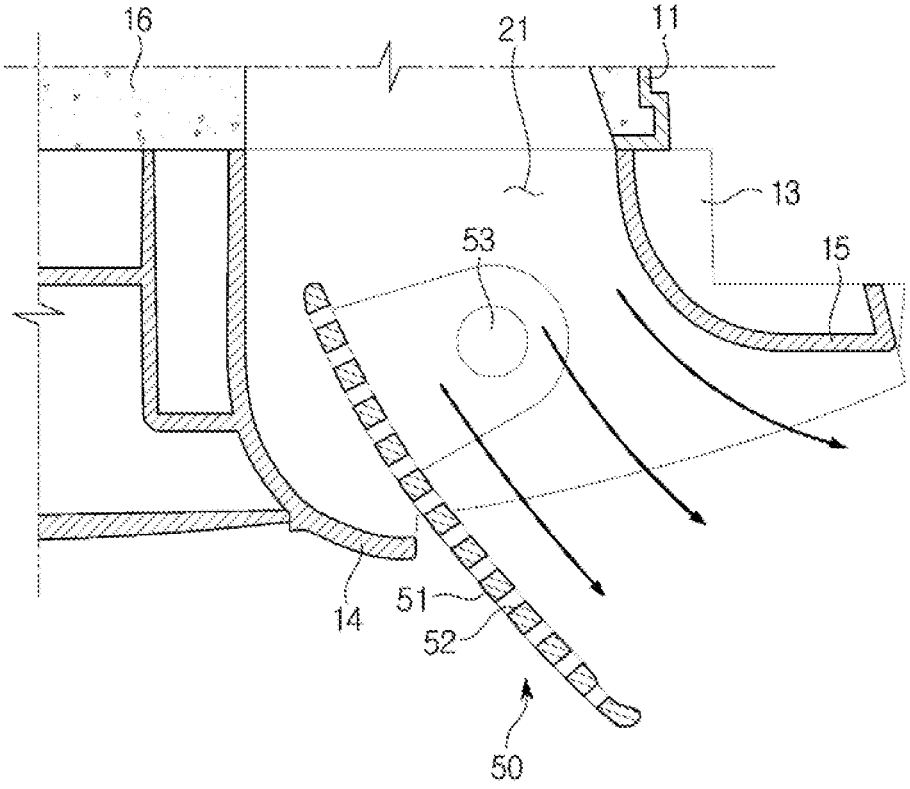
FIG. 4 is a view showing a state in which a blade shown in FIG. 3 is in a first position
Figure 5:
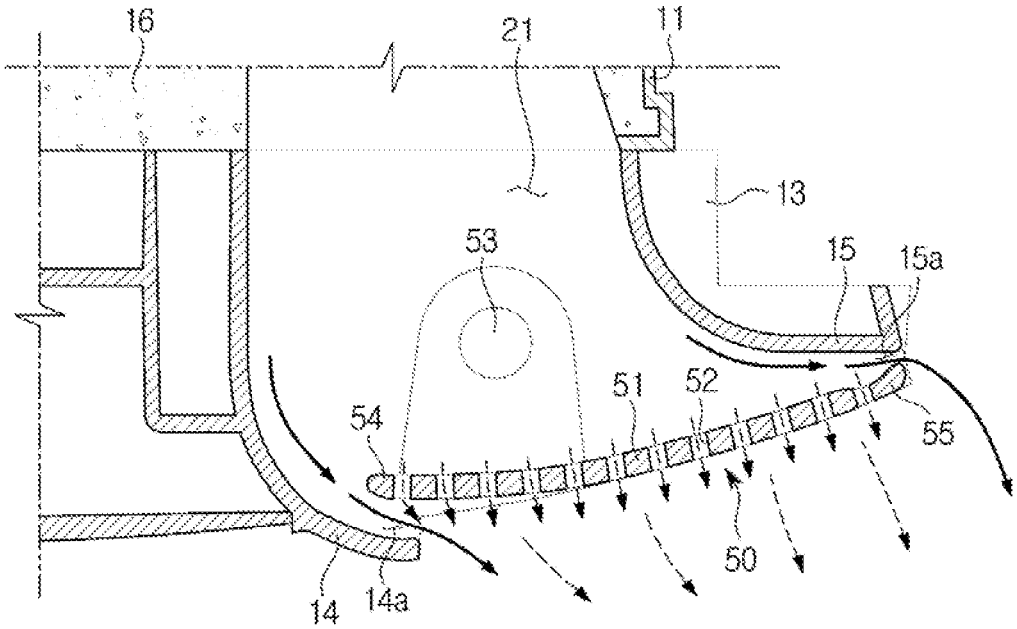
FIG. 5 is a view showing a state in which the blade shown in FIG. 3 is in a second position.

FIG. 3 is an enlarged view of a portion 'D' shown in FIG. 2. FIG. 4 is a view showing a state in which a blade shown in FIG. 3 is in a first position. FIG. 5 is a view showing a state in which the blade shown in FIG. 3 is in a second position.

Referring to FIGS. 3 to 5, the lower housing 13 may include the first guide portion 14 and the second guide portion 15 forming the outlet 21.

The first guide portion 14 may be disposed on one side near the inlet 20 on the outlet 21. The first guide portion 14 may extend from the front end of a first inner wall of the housing 10 forming the outlet 21.

When the blade 50 is in the second position (i.e. when the blade 50 discharges air through the plurality of discharge holes), the first guide portion 14 may be spaced apart from one end 54 of the blade 50 adjacent the inlet 20. When the blade 50 discharges air through the plurality of discharge holes 52, the first inner wall (i.e. the inner wall of the housing 10 in which the first guide portion 14 is formed) of the housing 10 forming the outlet 21 may be spaced apart from one end 54 of the blade 50 adjacent the inlet 20.

Particularly, the first guide portion 14 may extend inwardly of the outlet 21 such that at least one portion of the first guide portion is disposed below one end 54 of the blade 50 when the blade 50 is in the second position (i.e. when the blade 50 discharges air through the plurality of discharge holes).

That is, the first guide portion 14 may extend inwardly of the outlet 21 so that the first guide portion is spaced apart from one end 54 near the inlet 20 when the blade 50 is in the second position (i.e. when the blade 50 discharges air through the plurality of discharge holes). A first opening 14*a* may be formed between the first guide portion 14 and the one end 54 of the blade 50.

Particularly, when the blade 50 is in the second position (i.e. when the blade 50 discharges air through the plurality of discharge holes) and when the length along the substantially horizontal direction of the blade 50 is L and the length in which the first guide portion 14 and the blade 50 overlap in the substantially horizontal direction is O, the length in which the first guide portion 14 and the blade 50 overlap in the substantially horizontal direction and the length along the substantially horizontal direction of the blade 50 may satisfy the following formula.

$$0.001 \leq O/L \leq 0.27$$

When the blade 50 is in the second position (i.e. when the blade 50 discharges air through the plurality of discharge holes) and when the height along the direction of gravity (-z direction) of the outlet 21 is H and the height along the direction of gravity of the first opening 14*a* is G1, the height of the outlet 21 along the direction of gravity and the height along the direction of gravity of the first opening 14*a* may satisfy the following formula.

$$0.01 \leq G1/H \leq 0.35$$

When the blade 50 is in the second position (i.e. when the blade 50 discharges air through the plurality of discharge holes), the first guide portion 14 may be provided to guide the air discharged through the first opening 14*a* in a direction away from the inlet 20. Particularly, when the blade 50 is in the second position (i.e. when the blade 50 discharges air through the plurality of discharge holes), the first guide portion 14 may guide the air discharged through the first opening 14*a* so that the air discharged through the first opening 14*a* pushes the air discharged through the plurality of discharge holes 52 in a direction away from the inlet 20.

The first opening 14*a* may be provided to discharge air at a higher speed than the speed of the air discharged through the plurality of discharge holes 52. For example, the first opening 14*a* may be formed larger than the size of each of the plurality of discharge holes 52. The first guide portion 14 may be arranged such that the distance G1 between the first guide portion 14 and the one end 54 of the blade 50 near the inlet 20 is larger than the diameter of the plurality of discharge holes 52 of the blade 50.

As the speed of the air discharged through the first opening 14*a* is faster than the speed of air discharged through the plurality of discharge holes 52, a high pressure may be formed around the first opening 14*a* and a low pressure may be formed around the plurality of discharge holes 52. Due to this pressure difference, the air discharged from the first opening 14*a* moves toward the discharged air through the plurality of discharge holes 52 and may push the discharged air through the plurality of discharge holes 52 in the direction away from the inlet 20.

The air conditioner 1 according to the embodiment of the present disclosure may prevent the air discharged through the plurality of discharge holes 52 from being re-introduced into the inlet 20 by the first guide portion 14.

The second guide portion 15 may be disposed on the outlet 21 at one side far from the inlet 20. The second guide portion 15 may extend from the front end of a second inner wall of the housing 10 forming the outlet 21.

When the blade 50 is in the second position (i.e. when the blade 50 discharges air through the plurality of discharge holes), the second guide portion 15 may be spaced apart from the other end 55 opposite to one end 54 of the blade 50 adjacent the inlet 20. When the blade 50 discharges air through the plurality of discharge holes 52, the second inner wall (i.e. the inner wall of the housing 10 where the second guide portion 15 is formed) of the housing 10 forming the outlet 21 may be spaced apart from the other end 55 of the blade 50 far from the inlet 20.

Particularly, when the blade 50 is in the second position (i.e. when the blade 50 discharges air through the plurality of discharge holes), the second guide portion 15 may be disposed so as to be spaced apart from the other end portion 55 of the blade 50 far from the inlet 20. A second opening 15*a* may be formed between the second guide portion 15 and the other end 55 of the blade 50.

Particularly, when the blade 50 is in the second position (i.e. the blade 50 discharges air through the plurality of discharge holes), and when the height of the outlet 21 along the direction of gravity is H and the height along the direction of gravity of the second opening 15*a* is G2, the height of the outlet 21 along the direction of gravity and the height of the second opening 15*a* along the direction of gravity may satisfy the following formula.

$$0.01 \leq G2/H \leq 0.022$$

The second guide portion 15 may guide the air discharged through the second opening 15*a* in the direction of gravity. The second opening 15*a* may be arranged such that the air discharged through the second opening 15*a* pushes the air discharged through the plurality of discharge holes 52 downward.

Particularly, the second opening 15*a* may be provided to discharge air at a higher speed than the speed of the air discharged through the plurality of discharge holes 52. For example, the second opening 15*a* may be formed larger than the size of each of the plurality of discharge holes 52. The second guide portion 15 may be disposed such that the distance G2 between the second guide portion 15 and the other end 55 far from the inlet 20 of the blade 50 is greater than the diameter of the plurality of discharge holes 52 of the blade 50.

As the speed of air discharged through the second opening 15*a* is faster than the speed of air discharged through the plurality of discharge holes 52, a high pressure may be formed around the second opening 15*a* and a low pressure may be formed around the plurality of discharge holes 52. Due to this pressure difference, the air discharged from the second opening 15*a* moves toward the discharged air through the plurality of discharge holes 52 and may push out the discharged air through the plurality of discharge holes 52 downwardly.

By the second guide portion 15, the air conditioner 1 according to the embodiment of the present disclosure may prevent the air, which is discharged through the plurality of discharge holes 52, from moving along the ceiling C without being lowered.

Figure 6:
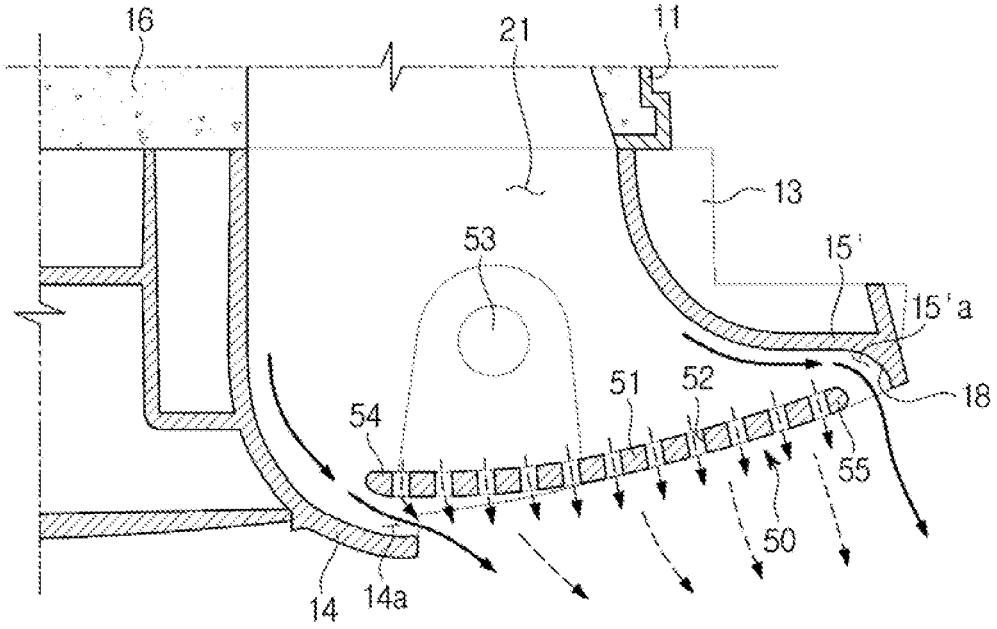
FIG. 6 is a view showing a modified embodiment of a second guide portion shown in FIG. 3.

FIG. 6 is a view showing a modified embodiment of a second guide portion shown in FIG. 3.

Referring to FIG. 6, a modified embodiment of the second guide portion 15 shown in FIG. 3 of the present disclosure will be described. In the following description about the embodiment shown in FIG. 6, the same components as those shown in FIGS. 1 to 5 are assigned as the same reference numerals, and descriptions thereof will be omitted.

A second guide portion 15' may include a guide curved portion 18 that guides the air discharging through a second opening 15'*a* so that the air discharged through the second opening 15'*a* pushes the air discharged through the plurality of discharge holes downward when the blade 50 discharges air through the plurality of discharge holes 52. The guide curved portion 18 may guide the discharged air along the second guide portion 15' in the direction of gravity. The guide curved portion 18 may protrude from the second guide portion 15' in the approximate direction of gravity.

The second guide portion 15 shown in FIGS. 1 to 5 may be arranged so that the air discharged from the second opening 15*a* is discharged at a higher speed than the air discharged through the plurality of discharge holes 52, accordingly, a high pressure is formed outside the second opening 15*a*, a low pressure is formed outside the plurality of discharge holes 52, and due to this pressure difference, the air discharged from the second opening 15*a* may push out the air discharged through the plurality of discharge holes 52 in the approximate direction of gravity.

The second guide portion 15' shown in FIG. 6 may be provided such that the air discharged from the second opening 15'*a* pushes out the air discharged through the plurality of discharge holes 52 by using the pressure difference as shown in FIG. 1 to FIG. 5, and the second guide portion 15' is configured such that the air discharged from the second opening 15'*a* may more effectively push out the air, which is discharged through the plurality of discharge holes 52, downward by the guide curved portion 18.

Figure 7:
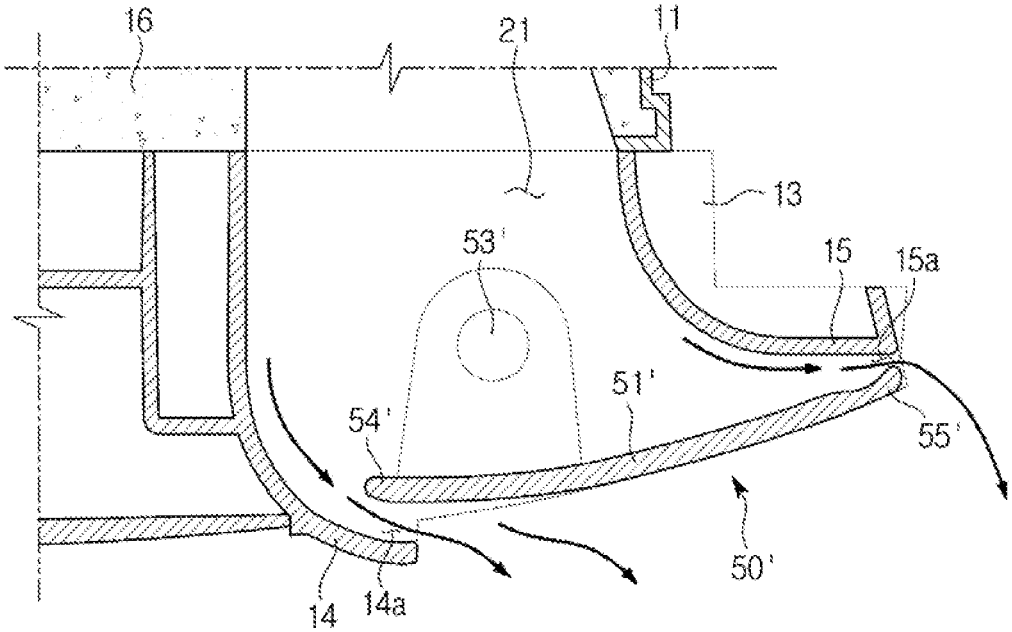
FIG. 7 is a view showing a modified embodiment of the blade shown in FIG. 3.

FIG. 7 is a view showing a modified embodiment of the blade shown in FIG. 3.

Referring to FIG. 7, a modified embodiment of the blade 50 shown in FIG. 3 of the present disclosure will be described. In the following description about the embodiment shown in FIG. 7, the same components as those shown in FIGS. 1 to 5 are assigned as the same reference numerals, and descriptions thereof will be omitted.

A blade 50' may not include a plurality of discharge holes unlike the configuration shown in FIGS. 1 to 5. The blade 50' may include a blade body 51' in which a plurality of discharge holes are not formed. The blade body 51' rotates about a rotation axis 53' and may guide the air discharged through the outlet 21. The blade 50' may be provided rotatably between a first position and a second position about the rotation axis 53'.

When the blade 50' is in the second position, the air blown from the blower fan 40 may pass through the outlet 21 and be discharged to the outside of the housing 10 through the first opening 14*a* and/or the second opening 15*a*. Since the plurality of discharge holes are omitted in the blade 50' shown in FIG. 7, the air passing through the outlet 21 is not discharged through the plurality of discharge holes as in the embodiment shown in FIGS. 1 to 5 but may be discharged to the outside of the housing 10 through the first opening 14*a* and/or the second opening 15*a*.

Particularly, when the blade 50' is in the second position, the first guide portion 14 may guide the air discharged through the first opening 14*a* in a direction away from the inlet 20. The second guide portion 15 may be provided such that, when the blade 50' is in the second position, the air discharged through the second opening 15*a* moves in the substantially downward direction due to the pressure difference.

Figure 8:
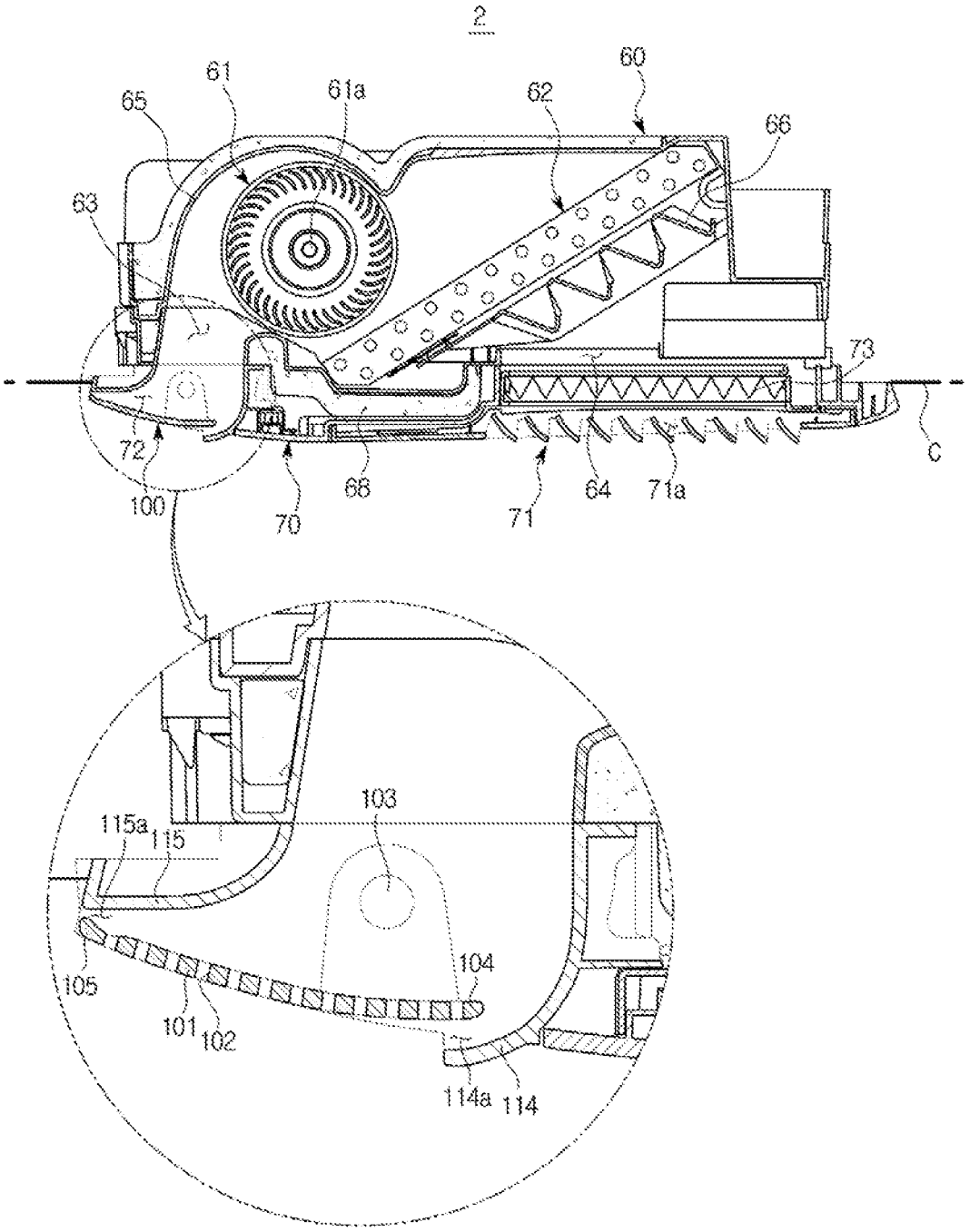
FIG. 8 is a side cross-sectional view of an air conditioner according to another embodiment of the present disclosure.

FIG. 8 is a side cross-sectional view of an air conditioner according to another embodiment of the present disclosure.

Referring to FIG. 8, an air conditioner 2 according to another embodiment of the present disclosure may include a main body 60 that is provided to be suspended from the ceiling C or embedded in the ceiling C, and a housing 70 coupled to a lower portion of the main body 60. The air conditioner according to another embodiment of the present disclosure may be provided in a 1-way type.

The main body 60 may be formed in a substantially box shape. Inside the main body 60, a heat exchanger 62 for exchanging the refrigerant with the air introduced into the main body 60, a blower fan 61 for forcedly flowing air, and a control unit (not shown) for controlling the operation of the air conditioner 1 may be provided.

The main body 60 includes an upper surface and side surfaces forming front, rear, left and right of the main body 60. The main body 60 may include a scroll portion 65 for guiding the heat exchanged air through the heat exchanger 62 to an outlet 63.

The heat exchanger 62 may include a tube through which refrigerant flows and a heat exchange fin in contact with the tube to increase the heat transfer area. The heat exchanger 62 may be arranged to be inclined so as to be substantially orthogonal to the direction of air flow.

A guide rib 66 may be provided between the heat exchanger 62 and the inlet 64 to guide the air introduced into the main body 60 through the inlet 64 toward the heat exchanger 62. The guide ribs 66 may be arranged to be inclined so as to be substantially orthogonal to the arrangement direction of the heat exchanger 62.

A drain cover 68 may be provided below the heat exchanger 62 to collect condensate generated in the heat exchanger 62. The condensed water collected through the drain cover 68 may be drained to the outside through a drain hose (not shown).

The blower fan 61 rotates by the driving force of a driving motor (not shown) and may force air to flow. A rotation axis

61*a* of the blower fan 61 may be provided substantially horizontally with respect to the ground. The blower fan 61 may be a cross flow fan.

The housing 70 may have a grille 71 provided at a position corresponding to the inlet 64 to prevent foreign matter from entering the interior of the main body 60, and a panel outlet 72 provided at a position corresponding to the outlet 63. The panel outlet 72 may be provided with a blade 100 capable of opening and/or closing the panel outlet 72 or controlling the vertical direction of the discharged air. The panel outlet 72 is formed in the housing 70 and connected to the outlet 63 so that the outlet 63 and the panel outlet 72 are hereinafter referred to as an outlet 72 in the following description.

The housing 70 may include a filter member 73 for filtering out foreign substances in the air flowing into the interior of the main body 60 through the inlet 64.

The filter member 73 may be loaded with many foreign substances in use and therefore requires cleaning or replacement. The grille 71 may be rotatably provided with respect to the housing 70 so that the filter member 73 is easily separated. The grille 71 may be provided to open and close the inlet 64 while rotating in a state where the rear side of the grille 71 is fixed to the housing 70.

The grille 71 is provided to be disposed below the filter member 73 of the housing 70 and may include a grille inlet 71*a* in which at least a portion of thereof is cut out.

The air conditioner 1 may include a blade driving unit (not shown) disposed at opposite ends of the blade 100 and configured to rotate the blade 100. The blade driving unit may be disposed at opposite ends of the blade 100, or may be disposed at only one end of opposite ends of the blade 100.

The blade 100 shown in FIG. 8 may be provided in the same configuration as the blade 50 shown in FIGS. 1 to 5. The blade 100 shown in FIG. 8 may include a blade body 101 and a plurality of discharge holes 102 passing through the blade body 101. The blade 100 may rotate about a rotation axis 103.

The blade 100 shown in FIG. 8 may be formed such that one end 104 near the inlet 64 is spaced apart from the first guide portion 114 in the same manner as the blade 50 shown in FIGS. 1 to 5, therefore, a first opening 114*a* may be formed between the one end 104 of the blade 100 and the first guide portion 114.

The blade 100 may be formed such that the other end 105 far from the inlet 64 is spaced apart from the second guide portion 115, therefore, a second opening 115*a* may be formed between the other end 105 of the blade 100 and the second guide portion 115.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. An air conditioner comprising:

a housing having an inlet and an outlet;

a blade having first and second sides opposite to each other, and a plurality of discharge holes extending through the blade from the first side to the second side, wherein the blade is rotatable to a first position in which the first side extends from inside the housing to outside the housing so that the first side guides air inside the housing to be discharged through the outlet to outside the housing, and a second position in which the first side faces inside of the housing and the second side faces outside the housing, a first opening is formed between a first end of the blade and a portion of the housing forming a first end of the outlet, wherein the first end of the blade is a proximal end of the blade to the portion of the housing forming the first end of the outlet, a second opening is formed between a second end, opposite to the first end, of the blade and a portion of the housing forming a second end, opposite to the first end, of the outlet, wherein the second end of the blade is a proximal end of the blade to the portion of the housing forming the second end of the outlet, a first flow path is formed for air inside the housing to flow through the first opening to be discharged through the outlet to outside the housing, a second flow path is formed for air inside the housing to flow through the second opening to be discharged through the outlet to outside the housing, a third flow path is formed for air inside the housing to flow through the plurality of discharge holes to be discharged through the outlet to outside the housing, and the portion of the housing forming the first end of the outlet is a first guide portion configured to guide air flowing along the first flow path to outside the housing in a direction away from the inlet so as to push air flowing along the third flow path to outside the housing in a direction away from the inlet.

2. The air conditioner according to claim 1, wherein at least a portion of the first guide portion is disposed below the blade when the blade is in the second position.

3. The air conditioner according to claim 1, wherein the air conditioner is embeddable in a ceiling and, when the air conditioner is embedded in the ceiling and the blade is in the second position, a length along a horizontal direction of the blade is L, a length in which the first guide portion and the blade overlap in the horizontal direction is O, and the length in which the first guide portion and the blade overlap in the horizontal direction and the length along the horizontal direction of the blade satisfy the following formula, $$0.001 \leq O/L \leq 0.27.$$

4. The air conditioner according to claim 1, wherein the air conditioner is embeddable in a ceiling and, when the air conditioner is embedded in the ceiling and the blade is in the second position, a height of the outlet along a vertical direction is H, a height of the first opening along the vertical direction is G1, and the height of the outlet along the vertical direction and the height of the first opening along the vertical direction satisfy the following formula, $$0.01 \leq G1/H \leq 0.35.$$

5. The air conditioner according to claim 1, wherein the first opening is configured to discharge air at a speed faster than a speed of air discharged through the plurality of discharge holes when the blade is in the second position.

6. The air conditioner according to claim 1, wherein the second opening is configured to discharge air at a speed faster than a speed of air discharged through the plurality of discharge holes when the blade is in the second position.

7. The air conditioner according to claim 1, wherein the air conditioner is embeddable in a ceiling and, when the air conditioner is embedded in the ceiling and the blade is in the second position, the second opening is disposed such that air flowing through the second opening pushes downward air flowing through the plurality of discharge holes.

8. The air conditioner according to claim 1, wherein the air conditioner is embeddable in a ceiling and, when the air conditioner is embedded in the ceiling and the blade is in the second position, the portion of the housing forming the second end of the outlet is a second guide portion configured to guide air flowing through the second opening in a vertical direction.

9. The air conditioner according to claim 8, wherein, when the air conditioner is embedded in the ceiling and the blade is in the second position, the second guide portion guides air flowing through the second opening so that the air flowing through the second opening pushes air flowing through the plurality of discharge holes downward.

10. The air conditioner according to claim 1, wherein the air conditioner is embeddable in a ceiling and, when the air conditioner is embedded in the ceiling and the blade is in the second position, a height of the outlet along a vertical direction is H, a height of the second opening along the vertical direction is G2, and the height of the outlet along the vertical direction and the height of the second opening along the vertical direction satisfy the following formula, $$0.01 \leq G2/H \leq 0.022.$$

11. The air conditioner according to claim 1, wherein the air conditioner is embeddable in a ceiling and, when the air conditioner is embedded in the ceiling and the blade is in the second position, a length of the blade along the horizontal direction is L, a length from an inner end to an outer end of the outlet is M, and the height of the blade along the horizontal direction and the length from the inner end to the outer end of the outlet satisfy the following formula, $$M < L.$$

12. The air conditioner according to claim 1, wherein the air conditioner is a ceiling type air conditioner that is embeddable in a ceiling.

* * * * *